US010479660B2

(12) United States Patent
Smith

(10) Patent No.: US 10,479,660 B2
(45) Date of Patent: Nov. 19, 2019

(54) WINDLASS SYSTEM AND METHOD WITH ATTENUATED STOP FUNCTION

(71) Applicant: Frederick L. Smith, Park Ridge, NJ (US)

(72) Inventor: Frederick L. Smith, Park Ridge, NJ (US)

( * ) Notice: Subject to any disclaimer, the term of this patent is extended or adjusted under 35 U.S.C. 154(b) by 0 days.

(21) Appl. No.: 16/235,141

(22) Filed: Dec. 28, 2018

(65) Prior Publication Data

US 2019/0202673 A1 Jul. 4, 2019

Related U.S. Application Data

(60) Provisional application No. 62/611,301, filed on Dec. 28, 2017.

(51) Int. Cl.

| | |
|---|---|
| ***B66D 1/48*** | (2006.01) |
| ***B66D 3/20*** | (2006.01) |
| ***B66D 3/26*** | (2006.01) |
| *B66D 1/38* | (2006.01) |

(52) U.S. Cl.

CPC ..... *B66D 1/485* (2013.01); *B66D 3/20* (2013.01); *B66D 3/26* (2013.01); *B66D 1/38* (2013.01)

(58) Field of Classification Search

CPC ..... B66D 1/48–525; B66D 3/18–26

See application file for complete search history.

(56) References Cited

U.S. PATENT DOCUMENTS

| | | | | |
|---|---|---|---|---|
| 4,046,355 | A * | 9/1977 | Martin | B66D 1/50 254/273 |
| 4,132,387 | A * | 1/1979 | Somerville | B66D 1/52 254/340 |
| 6,094,024 | A * | 7/2000 | Westlake | B66D 5/02 318/375 |
| 7,019,496 | B1 * | 3/2006 | Garretson | H02P 9/102 320/104 |
| 8,207,692 | B2 * | 6/2012 | Holmberg | B66D 1/505 114/230.1 |
| 8,517,348 | B2 | 8/2013 | Smith | |
| 8,729,836 | B2 * | 5/2014 | Maruno | B66D 3/18 318/10 |
| 9,365,265 | B2 * | 6/2016 | Janik | B66D 1/485 |
| 2015/0292250 | A1 * | 10/2015 | Betker | E05D 15/38 49/199 |
| 2016/0159625 | A1 * | 6/2016 | Janik | B66D 1/485 254/362 |

* cited by examiner

*Primary Examiner* — Sang K Kim
*Assistant Examiner* — Nathaniel L Adams
(74) *Attorney, Agent, or Firm* — Arthur Jacob

(57) ABSTRACT

A windlass system and method in which an inertial force resulting from an abrupt removal of primary operating power from a primary source of power during a lifting operation being carried out by a windlass of the windlass system is attenuated to reduce load forces generated by the inertial force.

6 Claims, 7 Drawing Sheets

22
LHOOK
LC
AC LINE POWER
TLC
GND
120
CB
144
LCC
TH
FAN(S)
AC LINE POWER
PS24
146
24 VDC BUFFERED
UPSs
122
PDRs
130
SR
132
SROE
150
10
STO
152
SMD
12
OT
EOT
R
128R
EOT
OT
128L
L

140
BTC2
BTC1
140
112
SPR1
SPR2
62
24VDC
E-CAT/ FSOE
E-CAT/ FSOE
ENC
MTR
BK1
BK2
164
MT
DMC
E-STOP
E-CAT/ FSOE
F
DBR(S)
100
100
156
160
LINK
166
170
DII
USI
172
E-STOP
RAISE
LOWER
110
DCP
12
12
12
12

| | |
|---|---|
| BTC | - BRAKE TORQUE CONTROL |
| BK1(2) | - SHAFT SAFETY BRAKES |
| CB | - CIRCUIT BREAKER |
| DBR(S) | - DYNAMIC BRAKING RESISTOR(S) |
| DCP | - DEDICATED CONTROL PENDANT |
| DII | - DEDICATED INTELLIGENT INTERFACE |
| DMC | - DEDICATED MOTION CONTROLLER |
| E-STOP | - EMERGENCY STOP PUSHBUTTON |
| ENC | - ENCODER |
| EOT | - END OF TRAVEL |
| E-CAT/FSOE | - AUTOMATION NETWORK COMMUNICATIONS PLUS SAFETY |
| E-NET | - ETHERNET COMMUNICATIONS NETWORK |
| F | - FUSE |
| FAN(s) | - COOLING FANS |
| GND | - GROUND BOND |
| L | - LOWERED (EOT OR OT) |
| LC | - LOAD CELL |
| LCC | - LOAD CELL CONDITIONER |
| LHOOK | - LOAD HOOK |
| LINK | - ETHERCAT MUTI-UNIT LINK |
| LOWER | - LOWER PUSHBUTTON |
| MT | - MOTOR THERMAL DETECTOR |
| MTR | - MOTOR |
| OT | - OVER TRAVEL |
| PDRs | - POWER DETECTION RELAY(S) |
| PS24 | - 24 VOLT POWER SUPPLY |
| R | - RAISED (EOT OR OT) |
| RAISE | - RAISE PUSHBUTTON |
| SMD | - SERVO MOTOR DRIVE |
| SPR1(2) | - SLIP RINGS |
| SR | - SAFETY RELAY |
| SROE | - SAFETY RELAY OUTPUT EXPANDER |
| STO | - SAFE TORQUE OFF |
| TH | - THERMOSTAT |
| TLC | - TWIST LOCK CONNECTOR |
| UPSs | - 24 VOLT POWER SUPPLY BUFFER |
| USI | - USER SUPPLIED INTERFACE |

FIG. 7

WINDLASS SYSTEM AND METHOD WITH ATTENUATED STOP FUNCTION

This application claims the benefit of U.S. Provisional Patent Application Ser. No. 62/611,301, filed Dec. 28, 2017, the entire disclosure of which is incorporated herein by reference thereto.

The present invention relates generally to mechanisms in which excessive forces resulting from a sudden stop are attenuated so as to be reduced to a manageable level and pertains, more specifically, to a windlass system and method wherein a sudden stop resulting from an abrupt removal of operating power such as from a loss of power, an emergency or another uncontrolled event is accommodated without the generation of excessive forces that otherwise might occur as a result of a rapid deceleration occurring in the system.

For example, in a windlass system and method, such as that described in an earlier patent, U.S. Pat. No. 8,517,348, the entire disclosure of which is incorporated herein by reference thereto, a sudden loss of power during a raising, lowering, pulling or other operation can result in catastrophically high inertial forces.

The present invention provides a system and method that, in the event of an abrupt removal of operating power, such as that resulting from a loss of power, an emergency stop, or another sudden stop enables an attenuated stop function that reduces inertial forces to a manageable level, thereby avoiding a catastrophic and disastrous event. As such, the present invention attains several objects and advantages, some of which are summarized as follows: Provides a windlass system and method that, in the event of an abrupt removal of operating power during a lifting operation, avoids a catastrophic and disastrous event that could result in damage to surrounding structures as well as injury, or even death, to personnel in the vicinity; provides a relatively simple and compact windlass system that attenuates inertial forces to a manageable level in the event of an abrupt removal of operating power during operation of the windlass system; protects building structures against damage and personnel against injury that might otherwise occur upon rapid deceleration resulting from a loss of operating power in a windlass system; provides a highly versatile system for controlling multiple windlass mechanisms against excessive forces in the event of an abrupt removal of operating power; enables exemplary performance in a windlass system over an extended service life.

The above objects and advantages, as well as further objects and advantages, are attained by the present invention which may be described briefly as a windlass system in which an inertial force resulting from an abrupt removal of primary operating power from a primary source of power during a lifting operation being carried out by a windlass of the windlass system is attenuated to reduce load forces generated by the inertial force, the windlass system comprising: a drivetrain arranged for rotation within the windlass to move a load during the lifting operation; at least one safety brake arranged to engage the drivetrain for applying a rotation-retarding torque to the drivetrain; a power detector for detecting the abrupt removal of primary operating power; an auxiliary power supply for supplying auxiliary power upon detection by the power detector of the abrupt removal of primary operating power to actuate the safety brake to apply a rotation-retarding torque to the drivetrain in response to; a brake torque control arranged for operation by auxiliary power from the auxiliary power supply; and a drive controller for operation by auxiliary power from the auxiliary power supply in response to detection by the power detector of the abrupt removal of primary operating power to extend the rotation-retarding torque applied by the safety brake to the drivetrain over a predetermined interval, after which interval rotation of the drivetrain is discontinued and movement of the load is fully terminated, thereby effecting attenuation of the inertial force resulting from removal of the primary operating power.

In addition, the present invention provides a method for attenuating an inertial force resulting from an abrupt removal of primary operating power from a primary source of power during a lifting operation being carried out by a windlass of a windlass system to reduce load forces generated by the inertial force, the method comprising: arranging a drivetrain for rotation within the windlass to move a load during the lifting operation; providing at least one safety brake arranged to engage the drivetrain for applying a rotation-retarding torque to the drivetrain; detecting the abrupt removal of primary operating power; supplying auxiliary power to actuate the safety brake to apply a rotation-retarding torque to the drivetrain in response to detection of the abrupt removal of primary operating power; and operating a brake torque control by auxiliary power from the auxiliary power supply in response to detection of the abrupt removal of primary operating power, controlled to extend the rotation-retarding torque applied by the safety brake to the drivetrain over a predetermined interval, after which interval rotation of the drivetrain is discontinued and movement of the load is fully terminated, thereby effecting attenuation of the inertial force resulting from removal of the primary operating power.

The invention will be understood more fully, while still further objects and advantages will become apparent, in the following detailed description of preferred embodiments of the invention illustrated in the accompanying drawing in which:

FIG. 7 is a key to the schematic diagram of FIG. 5.

DEFINITIONS

Figure 1:
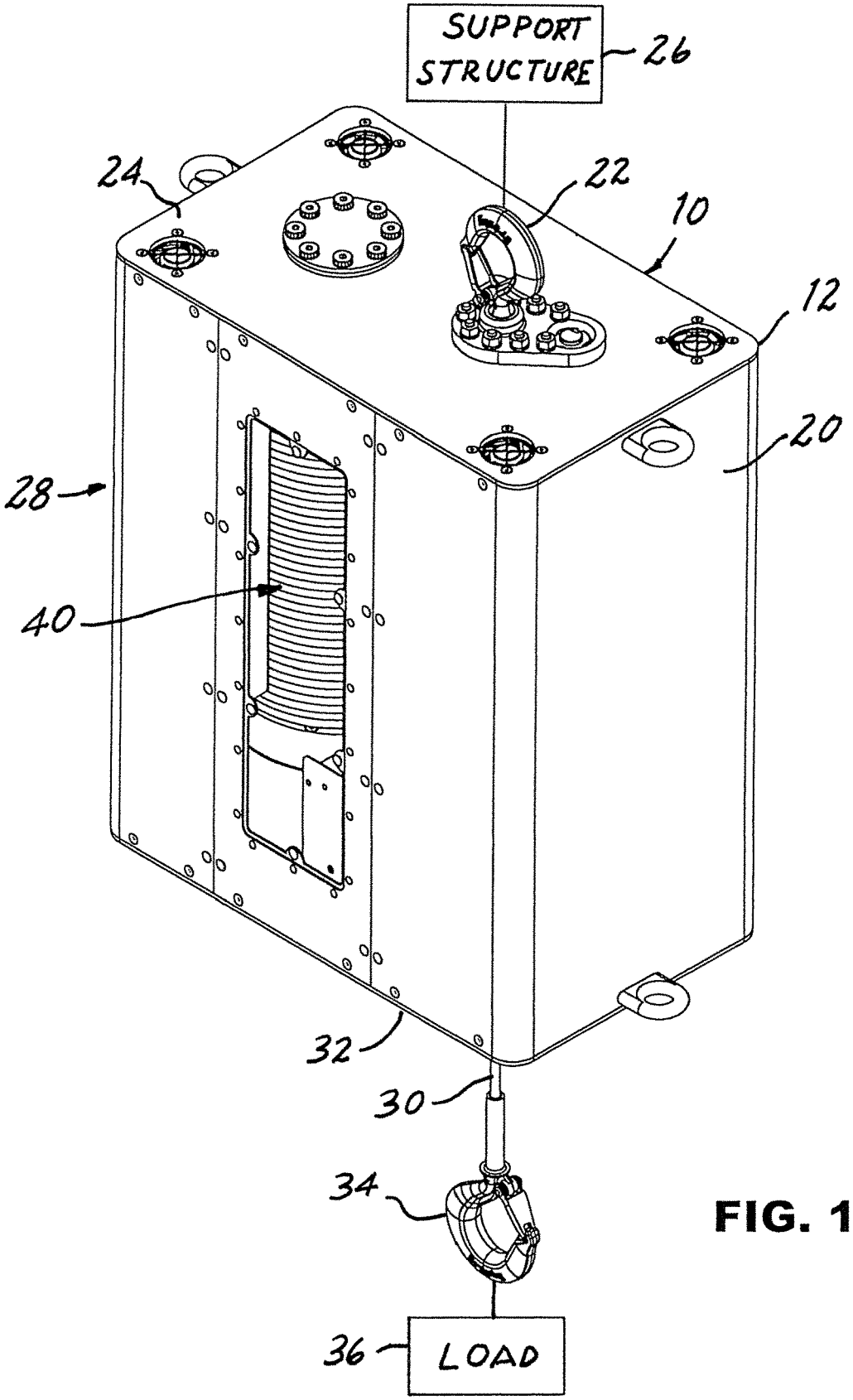
FIG. 1 is a top, front and left side pictorial view of a windlass system constructed in accordance with the present invention.
Figure 2:
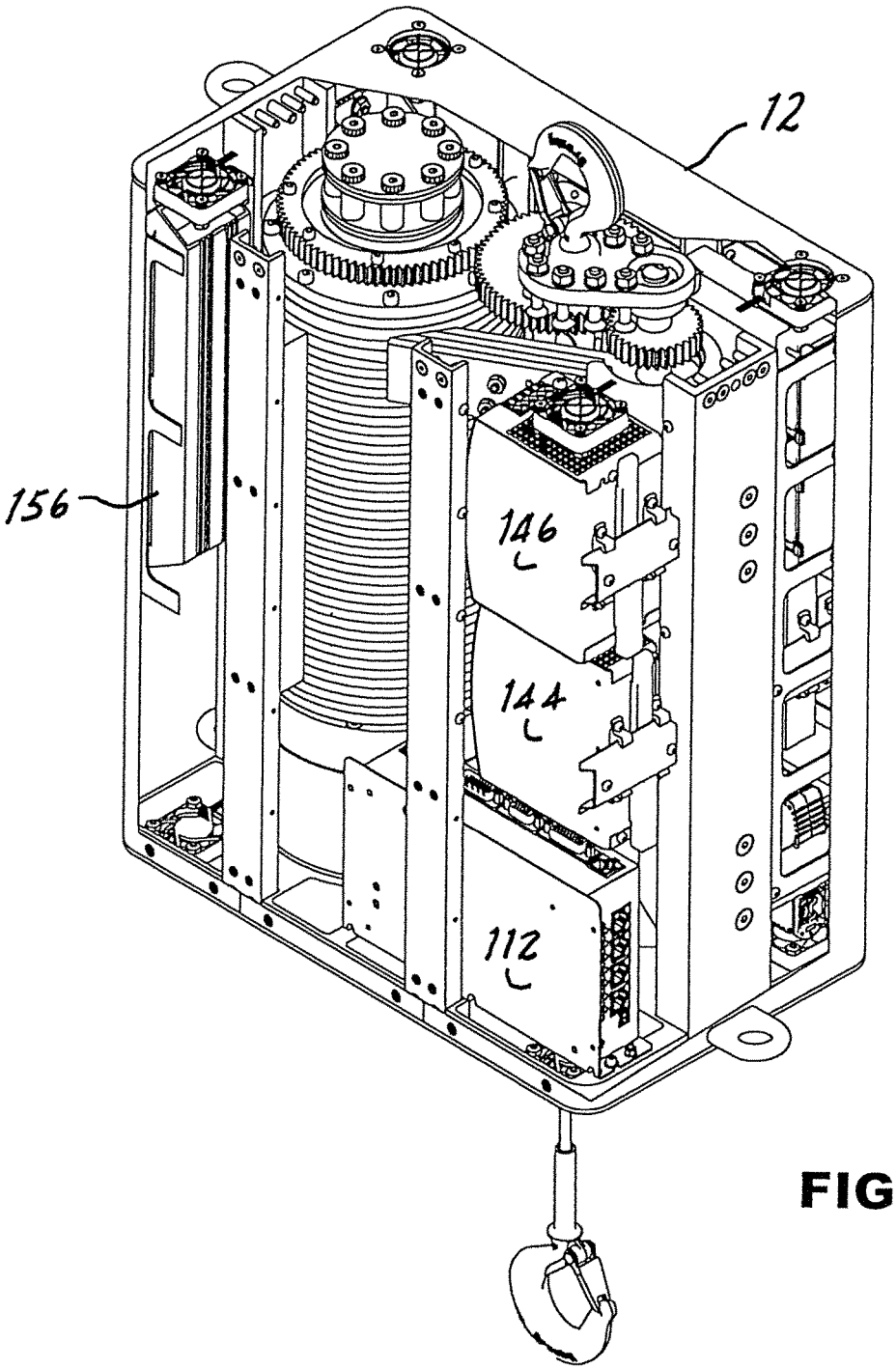
FIG. 2 is a pictorial view of the windlass system as viewed in FIG. 1, cutaway to reveal inner component parts.
Figure 3:
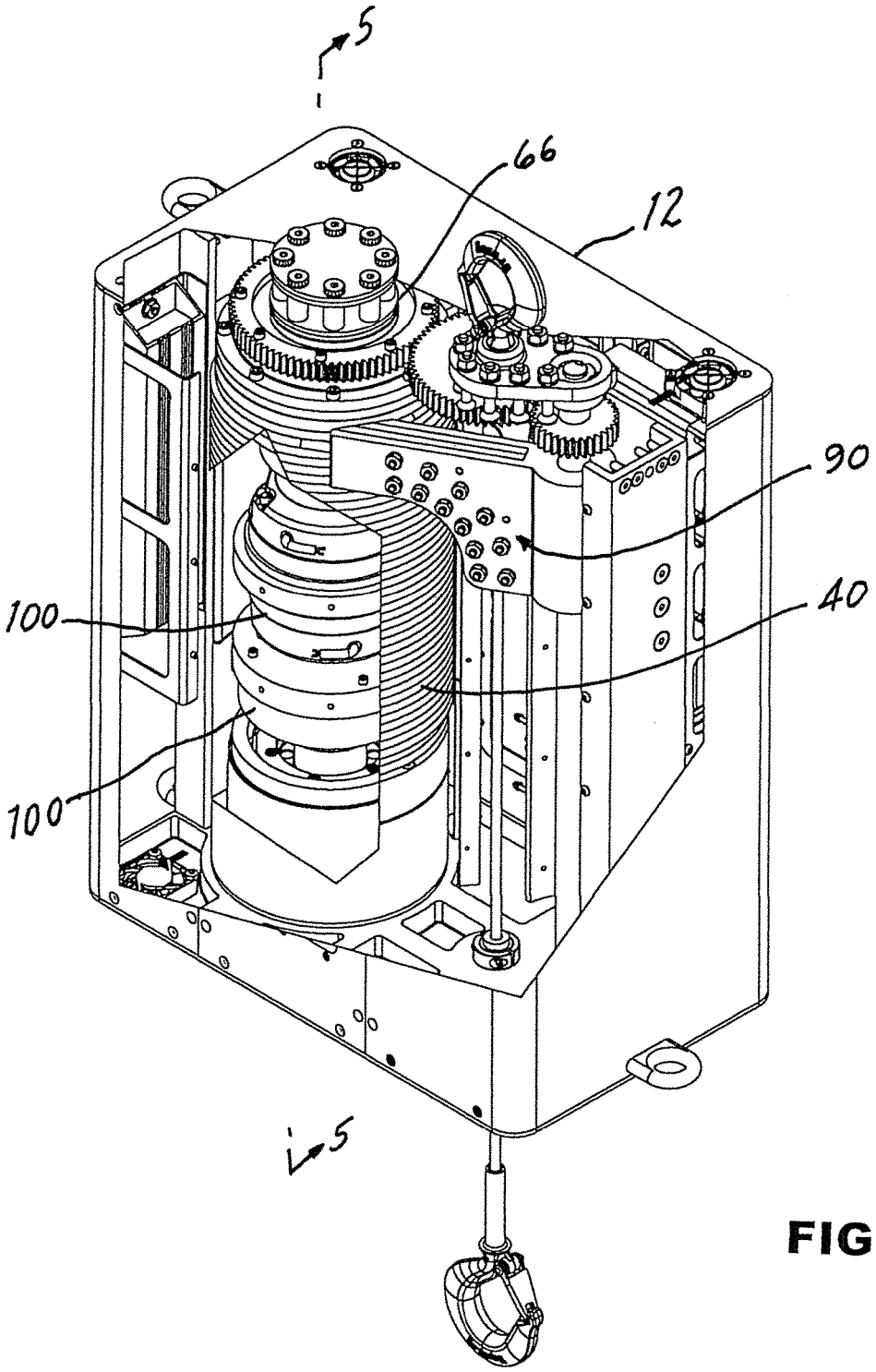
FIG. 3 is a pictorial view of the windlass system as viewed in FIG. 1, cutaway further to reveal further inner component parts.
Figure 4:
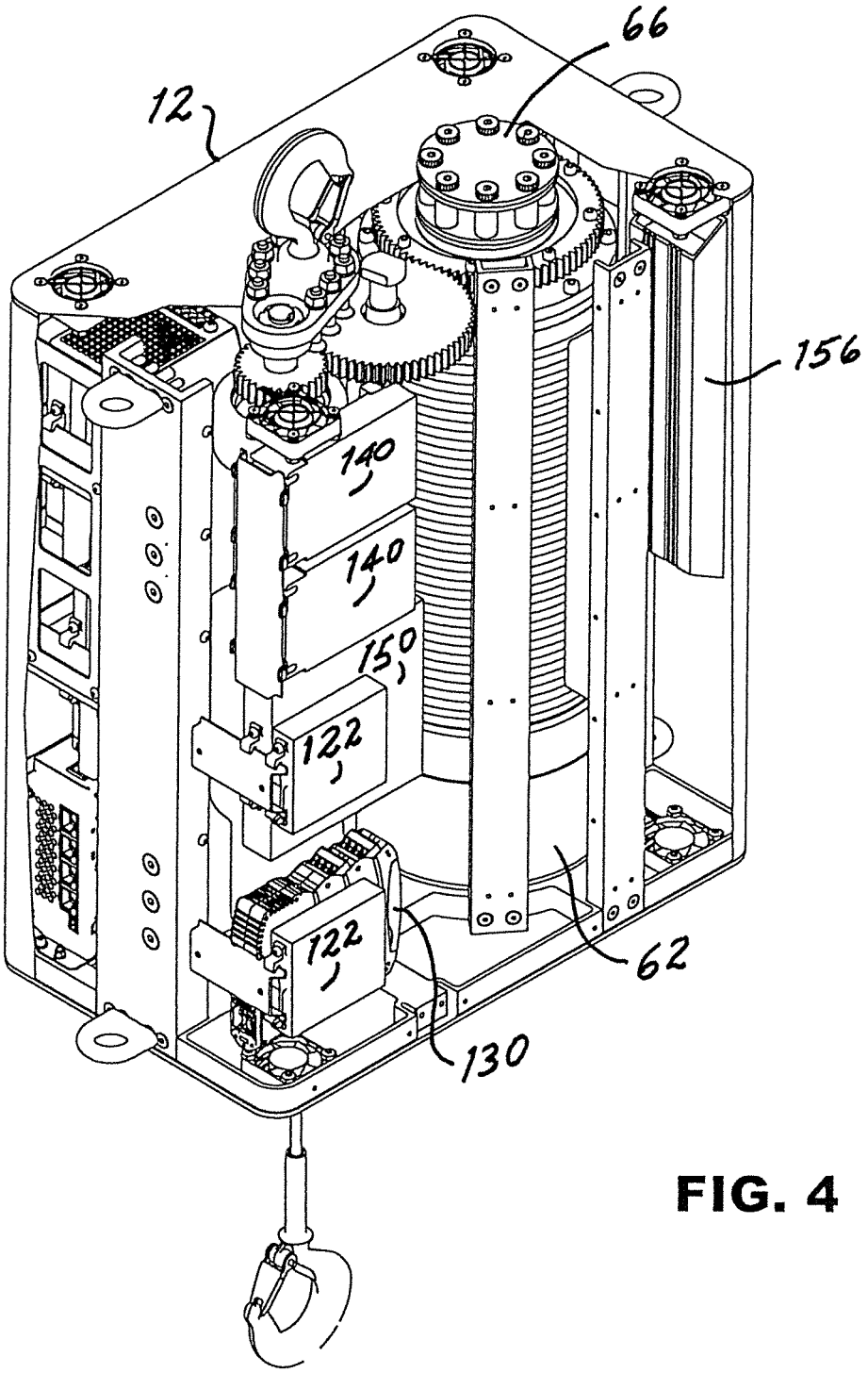
FIG. 4 is a top, rear and right side pictorial view of the windlass system, cutaway to reveal still further inner component parts.
Figure 5:
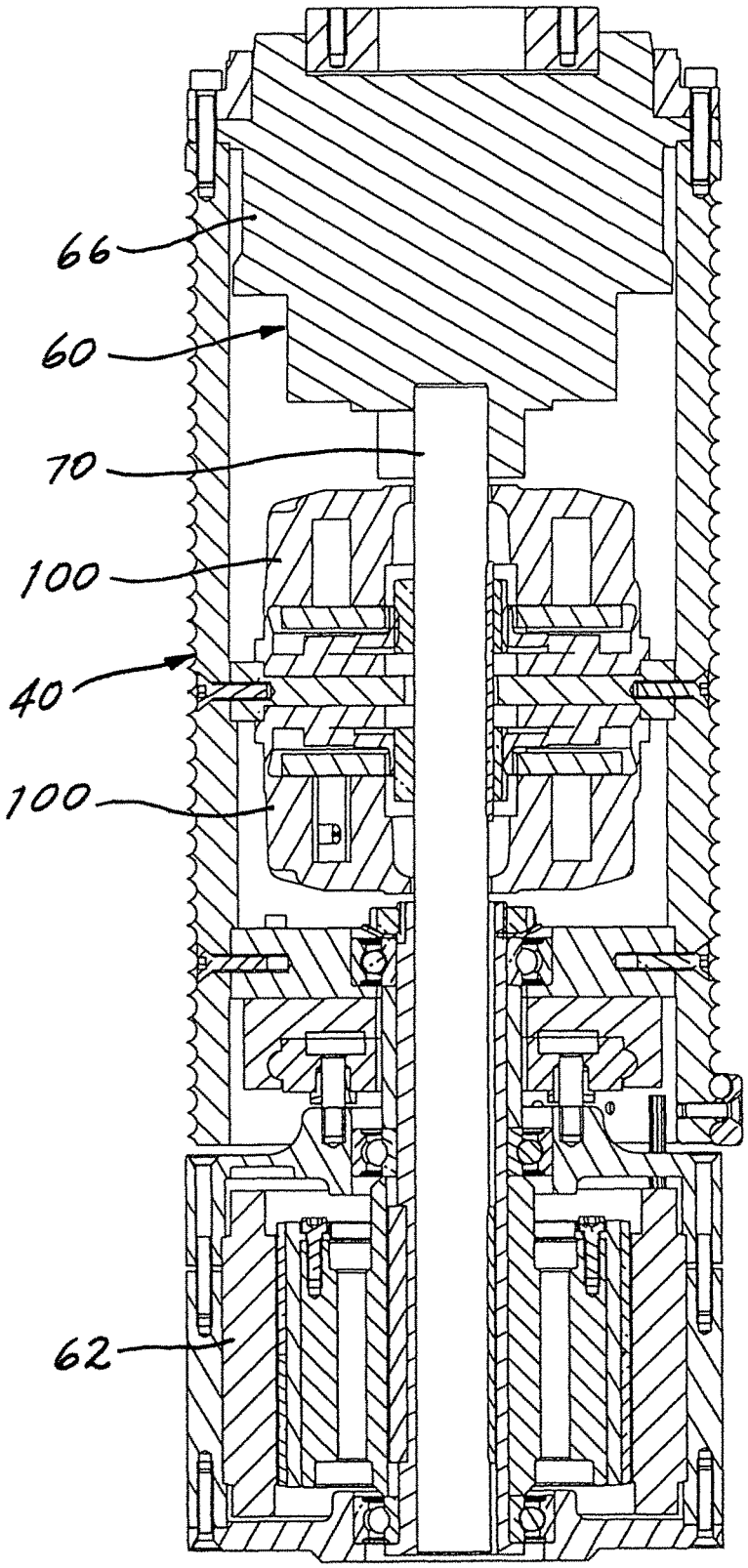
FIG. 5 is an enlarged longitudinal cross-sectional view of component parts of the windlass system, taken along line 5-5 of FIG. 3.
Figure 6:
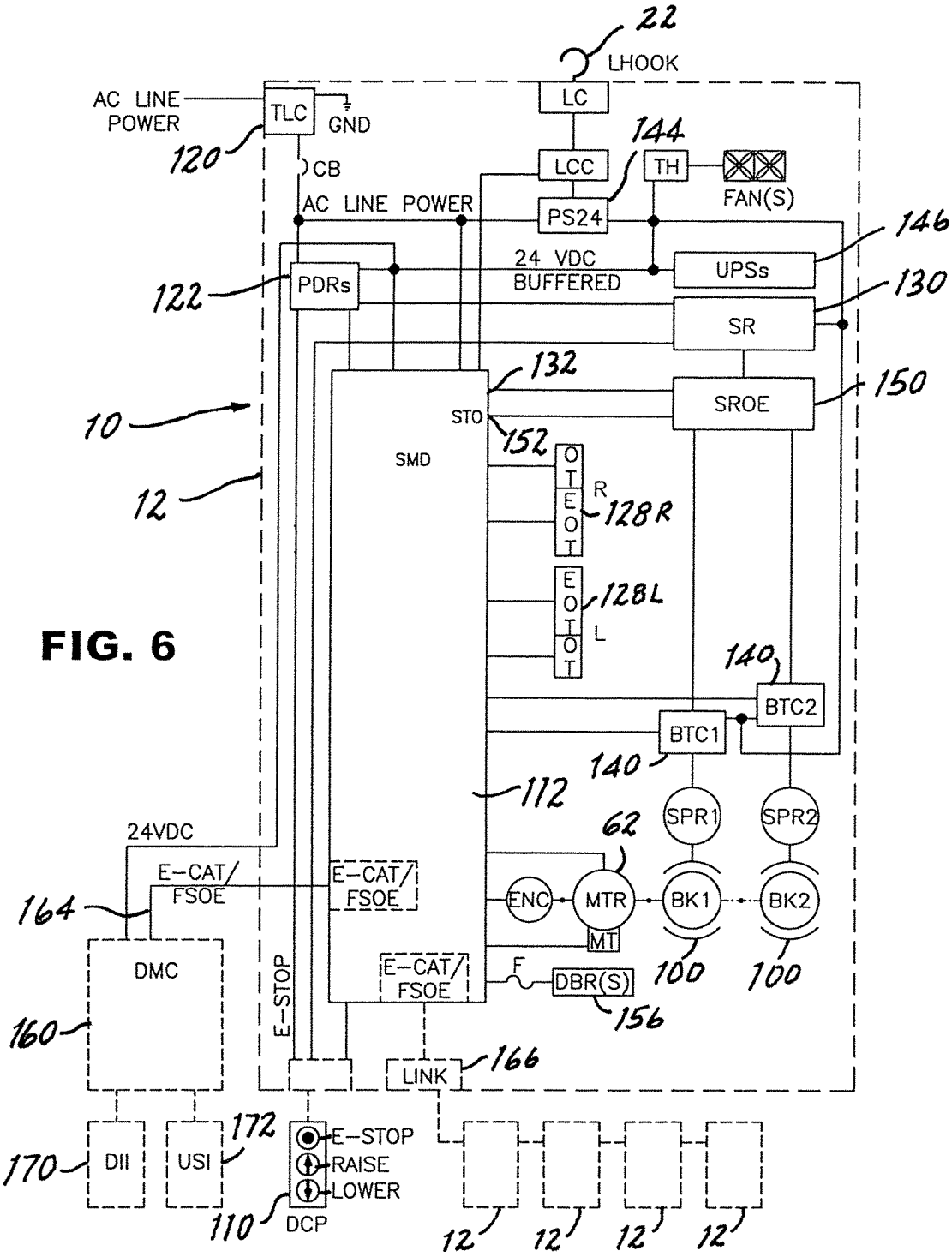
FIG. 6 is a schematic diagram of the windlass system.

Lifting Operation: Includes raising, lowering or pulling a load, using a windlass.

Emergency Stop Function: A sudden stop imposed on a mechanism occurring as a result of manual removal of operating power, an abrupt loss of system operating power, detection of a system fault, such as an over-speed condition, an over-travel, or a drive controller fault.

Stop Function Categories (see ISO 13850, IEC 602 04-1, NFPA 79):

Category 0 (NFPA): An uncontrolled stop by immediately removing power to the machine actuators. This results in very large dynamic forces being applied to all components of the machine, to the load and to the point of attachment of the machine to surrounding structures.

Category 1(NFPA): A controlled stop with power to the machine actuators available to achieve the stop, then power is removed when the stop is achieved. This results in a decelerated stop effected by a drive controller and motor with fail-safe brakes being applied when a full stop is achieved followed by de-energizing of the motor. Operating power is available to all machine components. When the machine has stopped, the fail-safe brakes are de-energized and hold the load stationary. Motor power is removed after the stop is achieved.

Category 2(NFPA): A controlled stop with power left available to the machine actuators. This results in a decelerated stop effected by a drive controller and motor with the fail-safe brakes being applied when a full stop is achieved. Operating power is available to all machine components. When the machine has stopped, the fail-safe brakes are de-energized and hold the load stationary. The system is ready for immediate subsequent use.

The present invention maintains all of the aforesaid stop function categories and adds a Category 0 "attenuated" stop function, as follows:

Attenuated Category 0: A new, non-standard stop function developed in accordance with the present invention and which is part of the Category 0 Stop Function, but includes an attenuation to eliminate the very large dynamic forces on the load, machine components and point of attachment of the machine to surrounding structures.

Dynamic forces and torques are caused by acceleration or deceleration of objects in motion. As the velocity of an object is increased or decreased quickly, the related dynamic forces and torques become very large. Standards prescribed by ANSI E1.6, "Entertainment Technology, Powered Hoist Systems" and ASME B30.7 "Safety Requirements for Base-Mounted Drum Hoists" require redundant brakes to ensure that all mechanical systems are able to"Fail-Safe". These same standards also require that each of these redundant brakes use a factor of safety of 1.25 times the maximum allowed or machine rated load. A machine with two brakes, each with a factor of safety of 1.25, results in a machine that has a braking factor of 2.5 times the maximum allowed or rated load. The definition of Fail-Safe Brake Torque (TQ) equals (2) brakes multiplied by a factor of safety (1.25) multiplied by load torque (TQmax). The present invention addresses a very rapid deceleration of a moving load and the associated rise of dynamic deceleration forces and torques.

A comparison of the Category 0 Stop Function and the Attenuated Category 0 Stop Function, in connection with a windlass system, is illustrated in the following TABLE 1.

TABLE 1

Category 0, vs. 'Attenuated' Category 0, STOP Functions

| | Inputs | Equations |
|---|---|---|
| 'Fail-Safe' Brake (TQ): | 7187.5 lbf-in | Fail-Safe Brake Torque (TQ) = 2 Brakes · (1.25 · Load Torque ($TQ_{Max}$)) |
| 'Attenuated Fail-Safe' Brake (TQ): | 4245.4 lbf-in | Load TQ = Load · (½ · Drum Pd) |
| Gravitational Accel (G): | 32.2 ft/s$^2$ | $\text{Brake TQ Factor} = \frac{\text{Brake TQ}}{\text{Load TQ}}$ |
| Load: | 1000.0 lbf | $\text{Deceleration (Decel) Factor} = \frac{\text{Brake TQ} - \text{Load TQ}}{\text{Load TQ}} = \text{Brake TQ Factor} - 1$ |
| Drum Pd: | 5.75 in | STOP Force = Brake TQ Factor · Load |
| Brake Response Delay: | 0.014 sec | $\text{STOP Time} = \frac{\text{Load Velocity}}{\text{Deceleration Factor} \cdot \text{Gravitational Acceleration}}$ |
| Brake Engagement Time: | 0.006 sec | STOP Distance = Load Velocity · STOP Time − (½ · Decel Factor · Gravitational Accel · (STOP Time)$^2$) |
| Load Velocity: | 60.0 ft/min | |
| Load Velocity: | 1.0 ft/sec | |
| Load Torque ($TQ_{max}$): | 2875.0 lbf-in | |

Sec 1 - Category 0, STOP Function

'Fail-Safe' Brake (TQ) (lbf-in): 7187.5

| No. | Load (lbf) | Load TQ (lb-in) | Brake TQ Factor (G) | Deceleration Factor (G) | STOP Force (lbf) | STOP Time (sec) | STOP Dist (in) |
|---|---|---|---|---|---|---|---|
| 1.1 | 100 | 287.5 | 25.00 | 24.00 | 2500 | 0.0153 | 0.016 |
| 1.2 | 200 | 575.0 | 12.50 | 11.50 | 2500 | 0.0167 | 0.032 |
| 1.3 | 300 | 862.5 | 8.33 | 7.33 | 2500 | 0.0182 | 0.050 |
| 1.4 | 400 | 1150.0 | 6.25 | 5.25 | 2500 | 0.0199 | 0.069 |
| 1.5 | 500 | 1437.5 | 5.00 | 4.00 | 2500 | 0.0218 | 0.090 |
| 1.6 | 600 | 1725.0 | 4.17 | 3.17 | 2500 | 0.0238 | 0.113 |
| 1.7 | 700 | 2012.5 | 3.57 | 2.57 | 2500 | 0.0261 | 0.139 |
| 1.8 | 800 | 2300.0 | 3.13 | 2.13 | 2500 | 0.0285 | 0.168 |
| 1.9 | 900 | 2587.5 | 2.78 | 1.78 | 2500 | 0.0315 | 0.201 |
| 1.10 | 1000 | 2875.0 | 2.50 | 1.50 | 2500 | 0.0347 | 0.238 |

TABLE 1-continued

| Sec 2 - Category 0, 'Attenuated' STOP Function | | | | | | | |
|---|---|---|---|---|---|---|---|
| 'Attenuated Fail-Safe' Brake (TQ) (lbf-in): 4245.4 | | | | | | | |
| No. | Load (lbf) | Load TQ (lb-in) | Brake TQ Factor (G) | Deceleration Factor (G) | STOP Force (lbf) | STOP Time (sec) | STOP Dist (in) |
| 2.1 | 100 | 287.5 | 14.77 | 13.77 | 1477 | 0.0233 | 0.107 |
| 2.2 | 200 | 575.0 | 7.38 | 6.38 | 1477 | 0.0271 | 0.157 |
| 2.3 | 300 | 862.5 | 4.92 | 3.92 | 1477 | 0.0315 | 0.202 |
| 2.4 | 400 | 1150.0 | 3.69 | 2.69 | 1477 | 0.0368 | 0.251 |
| 2.5 | 500 | 1437.5 | 2.95 | 1.95 | 1477 | 0.0431 | 0.308 |
| 2.6 | 600 | 1725.0 | 2.46 | 1.46 | 1477 | 0.0509 | 0.377 |
| 2.7 | 700 | 2012.5 | 2.11 | 1.11 | 1477 | 0.0607 | 0.463 |
| 2.8 | 800 | 2300.0 | 1.85 | 0.85 | 1477 | 0.0734 | 0.575 |
| 2.9 | 900 | 2587.5 | 1.64 | 0.64 | 1477 | 0.0906 | 0.725 |
| 2.10 | 1000 | 2875.0 | 1.48 | 0.48 | 1477 | 0.1149 | 0.938 |

Category 0 vs. 'Attenuated' Category 0, STOP Functions"

Equations of Motion for ALL Categories of STOP Fucntions:
Load Torque (TQ) (lbf-in) is the Load (lbf) multiplied by 1/2 multiplied by the Drum Pitch Diameter (5.75 in).
Brake Torque Factor (unit less) is the Fail-Safe Brake Torque (TQ) (lbf-in) divided by Load Torque (TQ) (lbf-in).
Deceleration (Decel) Factor (unit less) is (Fail-Safe Brake TQ (lbf-in) minus Load TQ (lbf-in)) divided by Load TQ (lbf-in) or Brake TQ Factor minus 1.0.
STOP Force (lbf) is the Brake TQ Factor multiplied by the Load (lbf).
STOP Time (sec) is Load Velocity (ft/sec) divided by (Deceleration (Decel) Factor multiplied by Gravitational Accel (G) (ft/sec2))
STOP Distance the (Load Velocity (1.0 ft/sec) multiplied by the STOP Time (sec) minus (1/2 multiplied by the Decel Factor multiplied by the Graviational Accel (G) (32.174 ft/sec$^2$) multiplied by the (Stop Time (sec))$^2$) multiplied by 12 (in/ft).
Sec 1 - Category 0, STOP Function: 'Fail-Safe' Brake (TQ): 7187.5 (lbf-in)
Fail-Safe Brake Torque (TQ) is (2) Brakes multiplied by a Factor of Safety (1.25) multiplied by Load Torque ($TQ_{max}$) equals 7187.5 (lbf-in).
No. 1.1 shows a Load of 100 lbf with a STOP Time of 15.3 msec will have a STOP Dist of 0.016 in. and will generate a STOP Force of 2500 lbf.
No. 1.5 shows a Load of 500 lbf with a STOP time 21.8 msec will have a STOP Dist of 0.090 in. and will generate a STOP Force of 2500 lbf.
No. 1.10 shows a Load of 1000 lbf with a STOP Time of 34.7 msec will have a STOP Dist of 0.238 in and will generate a STOP Force of 2500 lbf
Sec 2 - Category 0, 'Attenuated' STOP Function: 'Attenuated Fail-Safe' Brake (TQ): 4245.4 (lbf-in)
'Attenuated' Fail-Safe Brake Torque (TQ) is (2) Brakes multiplied by a Factor of Safety (1.25) multiplied by Load Torque ($TQ_{max}$) equals 4245.4 (lbf-in).
No. 2.1 shows a Load of 100 lbf with a STOP Time of 23.3 msec will have a STOP Dist of 0.107 in. and will generate a STOP Force of 1477 lbf.
No. 2.5 shows a Load of 500 lbf with a STOP time 43.1 msec will have a STOP Dist of 0.308 in. and will generate a STOP Force of 1477 lbf.
No. 2.10 shows a Load of 1000 lbf with a STOP Time of 114.9 msec will have a STOP Dist of 0.938 in and will generate a STOP Force of JUST 1477 lbf.

With reference now to the drawing, a windlass system constructed in accordance with the present invention is shown at 10 and is seen to include a windlass 12 having a frame in the form of a housing 20 and a mounting member in the form of a first hook 22 secured to the windlass 12 at the upper end 24 of the housing 20 for suspending the windlass 10 from a building structure or the like shown diagrammatically at 26, at an installation site 28 in a now-conventional manner. A line shown in the form of a wire rope 30 extends through lower end 32 of the housing 20 and carries a coupling member in the form of a second hook 34 provided for engaging a load, shown diagrammatically at 36, to be raised or lowered along vertical directions during a lifting operation.

A drum 40 is mounted for rotation within housing 20 and a drivetrain in the form of a drive mechanism 60 is coupled with the drum 40 for rotating the drum 40 selectively in either one of opposite spooling and unspooling directions of rotation, all as described more fully in the aforesaid U.S. Pat. No. 8,517,348. Drive mechanism 60 includes a servo motor 62, a gear drive 66 and a drive shaft 70, all arranged for rotating the drum 40. A line spooling mechanism 90 is located within housing 20, placed closely adjacent drum 40, all as described more fully in the aforesaid U.S. Pat. No. 8,517,348.

Fail-safe safety brakes 100 are placed within drum 40 and are arranged such that upon actuation of safety brakes 100, the safety brakes 100 engage drive shaft 70 to apply a torque for discontinuing rotation of drum 40. En the illustrated embodiment, two safety brakes 100 are incorporated for purposes of redundancy, as a safety measure. While in accordance with the prior art, safety brakes 100 would be actuated to stop rotation of drum 40 immediately, as described above in connection with a Category 0 Stop Function, windlass system 10 includes component parts for effecting an Attenuated Category 0 Stop Function, as set forth above. Thus, under normal operation, windlass 12 is oriented vertically and the load 36 is moved up or down in response to an operator (not shown) manually applying operation pressure to a control in the form of a RAISE pushbutton or a LOWER pushbutton located on a dedicated control pendant (DCP) 110. Increasing or decreasing the pressure on the selected variable speed pushbutton RAISE or LOWER will increase or decrease the speed of travel of the load 36 accordingly. Windlass 12 will decelerate to a stop when the operator releases pressure on the selected variable speed RAISE or LOWER pushbutton on pendant 110. The rate of deceleration, whether while raising or lowering the load 36, is programmed in a drive controller (SMD) 112. Acceleration or deceleration rate also is controlled so as to be limited if a pushbutton is depressed or released quickly. Upon coming to a stop, load 36 is held in position by the motor (MTR) 62 and after a preset interval, the redundant fail-safe safety brakes 100 are de-energized so as to engage drive shaft 70 of drive mechanism 60 and thereby hold the load 36 in place. The drive controller 112 then de-energizes the motor 62, and an enable signal is removed in order to assure safety.

Whereas, under a Category 0 Stop Function safety brakes 100 would engage drive shaft 70 of drive mechanism 60 instantaneously, resulting in the generation of a very large inertial force, under an Attenuated Category 0 Stop Function, as provided by the present invention, such a large inertial force is avoided. Thus, upon an abrupt removal of primary operating power, illustrated in the form of AC line power connected through connector (TLC) 120 to power detection relays (PDRs) 122, either by failure of the source of primary power, or by an operator depressing an emergency stop button (E-STOP) on pendant 110, or by over travel (OT), either while load 36 is being raised or lowered, as detected by respective limit switches 128R and 128L, or by a fault detected in the drive controller 112, a safety relay (SR) 130 receives a corresponding signal and activates an instantaneous digital output, through a safety relay output expander (SROE) 150, to an input 132 at the drive controller 112. The drive controller 112 continues to be powered by an auxiliary power supply in the form of power supply buffer (UPSs) 146 which has been maintained at 24 v DC by a power supply (PS24) 144 and now furnishes 24 v DC power to drive controller 112, which initiates a sequence in the drive controller 112 that turns on an analog output to redundant brake torque control modules 140 (BTC1 and BTC2) calling for an attenuated stop by a soft application of the safety brakes 100 to drive shaft 70 of drive mechanism 60. Brake torque control modules 140 are powered by power supply (PS24) 144 that furnishes regulated 24 v DC power to power supply buffer (UPSs) 146 which maintains DC power for operating brake torque control modules 140 subsequent to removal of the AC primary operating power. Under the soft application of the safety brakes 100, the safety brakes 100 apply a gradually increasing rotation-retarding torque to the drive shaft 70 of drive mechanism 60, extended over a predetermined interval, preferably approximately 115 milliseconds, after which interval rotation of the drive shaft 70 and, consequently, drive mechanism 60, is fully terminated and all movement of load 36 is stopped. In this manner, inertial forces that might otherwise result from an abrupt removal of the primary operating power are avoided. At least one, and preferably multiple dynamic braking resistors (DBR) 156 are included to absorb and dissipate energy generated by deceleration of the load 36.

Simultaneously, the safety relay 130 activates an additional instantaneous digital output, through safety relay output expander (SROE) 150, to a safe torque off (STO) input 152 of the drive controller 112, activating a safe torque off feature of the drive controller 112 to ensure that the drive controller 112 cannot provide power to the motor 62, thereby preventing any drive shaft 70 rotation that otherwise might be caused by the drive controller 112. With the safe torque off STO feature triggered, the safety relay 130 activates a time-delayed digital output that fully removes power from the safety brakes 100 after a prescribed time-delay, preferably approximately 120 milliseconds. As the load 36 will already be fully stopped, the safety brakes 100 will be fully engaged, regardless of the output of brake torque control modules 140.

In installations that require multiple windlasses 12 at selected locations, system 10 can include a dedicated motion controller (DMC) 160 connected through automation network communications that include a safety feature (E-CAT/FSOE) 164. Multiple windlasses 12 can be linked together through an E-CAT/FSOE multi-link (LINK) 166 and can be controlled, and even programmed, through the dedicated motion controller 160 working in concert with a dedicated intelligent interface (DII) 170 or a user supplied interface (USI) 172, to operate in any desired sequence of lifting operations. Any one of the multiple windlasses 12 is capable of detecting the abrupt removal of the primary operating power and initiating the safety sequence as set forth above in connection with the description of a single windlass 12.

It will be seen that the present invention attains all of the objects and advantages summarized above, namely: Provides a windlass system and method that, in the event of an abrupt removal of operating power during a lifting operation, avoids a catastrophic and disastrous event that could result in damage to surrounding structures as well as injury, or even death, to personnel in the vicinity; provides a relatively simple and compact windlass system that attenuates inertial forces to a manageable level in the event of an abrupt removal of operating power during operation of the windlass system; protects building structures against damage and personnel against injury that might otherwise occur upon rapid deceleration resulting from a loss of operating power in a windlass system; provides a highly versatile system for controlling multiple windlass mechanisms against excessive forces in the event of an abrupt removal of operating power; enables exemplary performance in a windlass system over an extended service life.

It is to be understood that the above detailed description of preferred embodiments of the invention is provided by way of example only various details of design, construction and procedure may be modified without departing from the true spirit and scope of the invention, as set forth in the appended claims The embodiments of the invention in which an exclusive property or privilege is claimed are defined as follows:

1. A windlass system in which an inertial force resulting from an abrupt removal of primary operating power from a primary source of power during a lifting operation being carried out by a windlass of the windlass system is attenuated to reduce load forces generated by the inertial force, the windlass system comprising:

a drivetrain arranged for rotation within the windlass to move a load during the lifting operation;

at least one safety brake arranged to engage the drivetrain for applying a rotation-retarding torque to the drivetrain;

a power detector for detecting the abrupt removal of primary operating power;

an auxiliary power supply for supplying auxiliary power upon detection by the power detector of the abrupt removal of primary operating power to actuate the safety brake to apply a rotation-retarding torque to the drivetrain in response to:

a brake torque control arranged for operation by auxiliary power from the auxiliary power supply; and a drive controller for operation by auxiliary power from the auxiliary power supply in response to detection by the power detector of the abrupt removal of primary operating power to extend the rotation-retarding torque applied by the safety brake to the drivetrain over a predetermined interval, after which interval rotation of the drivetrain is discontinued and movement of the load is fully terminated, thereby effecting attenuation of the inertial force resulting from removal of the primary operating power.

2. The windlass system of claim 1 including a manually operated control for selective removal of the primary operating power.

3. The windlass system of claim 1 including over travel detectors for effecting removal of the primary operating power upon detecting movement of the load beyond prescribed limits of travel.

4. The windlass system of claim 1 including:

at least two safety brakes arranged to engage the drivetrain for applying a rotation-retarding torque to the drivetrain; and at least two brake torque controls, each brake torque control being arranged to operate a corresponding safety brake in response to the drive controller upon detection by the power detector of the abrupt removal of primary operating power.

5. The windlass system of claim 1 wherein the predetermined interval is approximately 115 milliseconds.

6. The windlass system of claim 1 including:

a plurality of windlasses linked together by automation network communications; and a dedicated motion controller for operating the windlasses in a selected sequence of lifting operations.

* * * * *